US006626374B1

(12) United States Patent
Diedrick

(10) Patent No.: US 6,626,374 B1
(45) Date of Patent: Sep. 30, 2003

(54) DUAL PUMP HIGH PRESSURE CLEANING APPARATUS

(76) Inventor: Michael R. Diedrick, 4450 SW. 72 Way, Davie, FL (US) 33314

( * ) Notice: Subject to any disclaimer, the term of this patent is extended or adjusted under 35 U.S.C. 154(b) by 163 days.

(21) Appl. No.: 09/905,371

(22) Filed: Jul. 16, 2001

(51) Int. Cl.[7] ..... B05B 9/00

(52) U.S. Cl. ..... 239/127; 239/135; 239/146; 239/198

(58) Field of Search ..... 239/124–127, 239/135, 131, 146, 195–198; 222/608

(56) References Cited

U.S. PATENT DOCUMENTS 3,320,895 A * 5/1967 Peterson et al. ..... 239/127
3,380,658 A * 4/1968 Stasz et al. ..... 239/130
3,481,544 A * 12/1969 Jackson ..... 239/130
3,831,849 A * 8/1974 Studinger ..... 239/127
4,529,127 A * 7/1985 Huszagh ..... 239/127
4,613,074 A 9/1986 Schulze
4,821,958 A * 4/1989 Shaffer ..... 239/131
5,170,940 A 12/1992 Salber
5,533,671 A * 7/1996 Baer ..... 239/127
5,694,976 A 12/1997 Frye-Hammelmann
5,735,461 A 4/1998 Winther
5,816,499 A 10/1998 Christiansen
6,082,630 A * 7/2000 Bohrer ..... 239/127
6,227,460 B1 * 5/2001 Funk et al. ..... 239/131

* cited by examiner

*Primary Examiner*—Michael Mar
*Assistant Examiner*—Dinh Q. Nguyen
(74) *Attorney, Agent, or Firm*—Alvin S. Blum

(57) ABSTRACT

A high pressure cleaning apparatus provides a complete assembly mounted on a unitary base for applying high pressure water to two cleaning wands through two separate flexible hoses. A single engine drives two high pressure pumps through bypass mechanisms. A large water tank feeds the pumps. Each hose is mounted on its own reel. The water may be heated by water heaters also mounted on the base. Tanks for holding various cleaning agents are also provided, as well as receptacles for holding dispensing cans of the cleaning agents. The base is provided with features for lifting the entire assembly onto conveyances or work areas.

1 Claim, 2 Drawing Sheets

DUAL PUMP HIGH PRESSURE CLEANING APPARATUS

BACKGROUND OF THE INVENTION

This invention relates to high pressure cleaning apparatus, and more particularly to such apparatus providing two high pressure cleaning hoses fed by independent pumps driven by a common engine.

DESCRIPTION OF THE PRIOR ART

High pressure water is applied through flexible hoses to clean surfaces. A large water tank provides water to a three stage pump that generates water pressure over three thousand pounds/square inch. The pump feeds a long hose terminating in a cleaning wand with a manual control. The water may optionally be heated by a heater for enhanced cleaning. The power required to generate the intense pressure is provided by an internal combustion engine. Because of the great danger involved in handling the hose, the safety rules generally require that at least two people be present when the unit is in operation. The second person generally stands by with little to do. This is very wasteful of labor, making the cleaning operation more expensive.

SUMMARY OF THE INVENTION

It is accordingly an object of the invention to provide a high pressure cleaning apparatus that will not be so wasteful of labor, and make the operation less costly. It is an object of the invention to provide a high pressure cleaning apparatus that can allow the two persons who must be present during operation with their own high pressure hoses so that they can double the rate of cleaning without additional manpower. The apparatus of the invention provides a single water tank and engine that operates two separate high pressure pumps and hoses. The invention enables the same two workers to clean at double the rate of the prior art apparatus. The amount of water in the tank is the same required for cleaning a given area regardless of the rate of cleaning. There is a considerable saving in using one larger engine over two separate smaller engines.

These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 1:
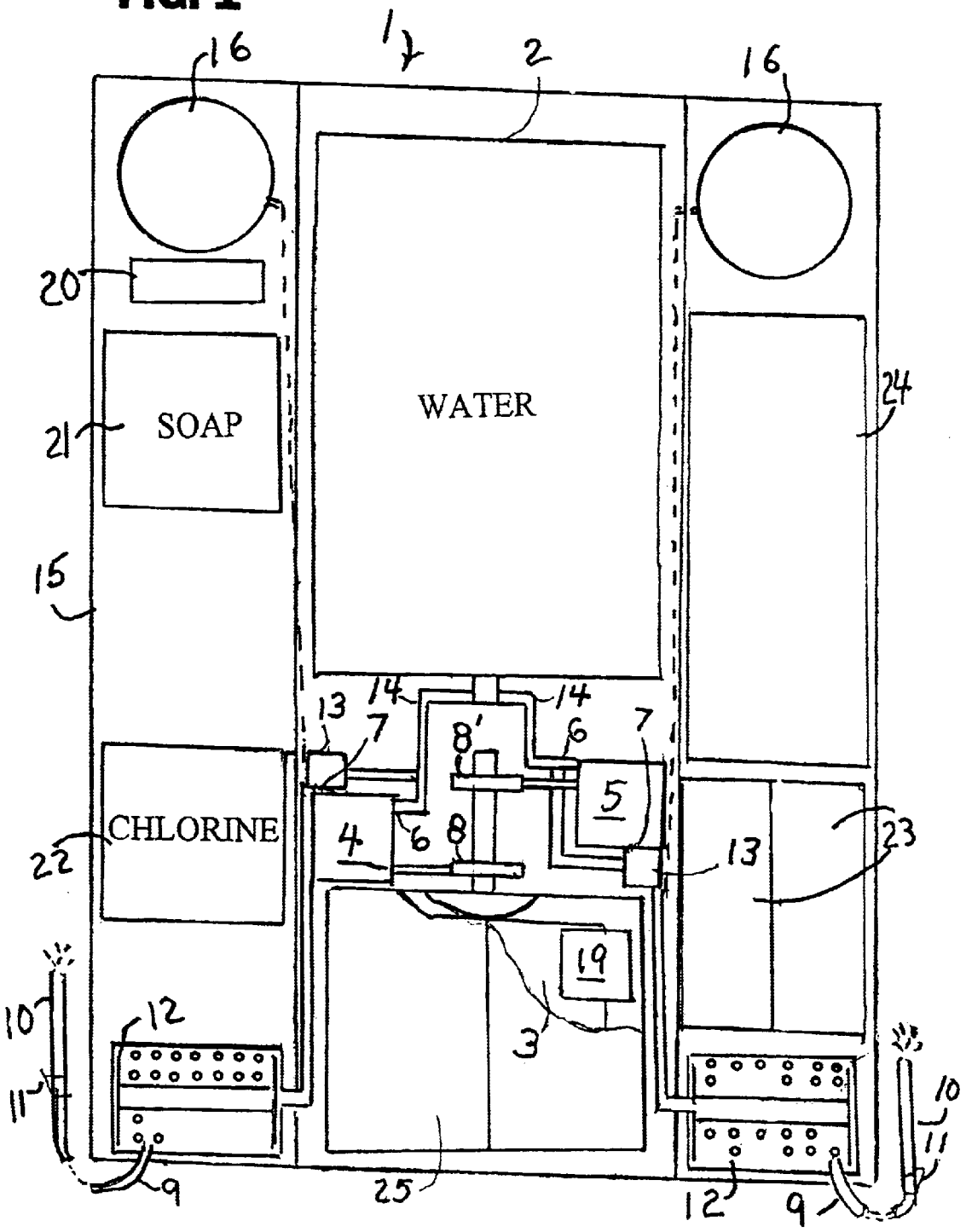
FIG. 1 is a diagrammatic top view of the apparatus of the invention, with portions broken away.
Figure 2:
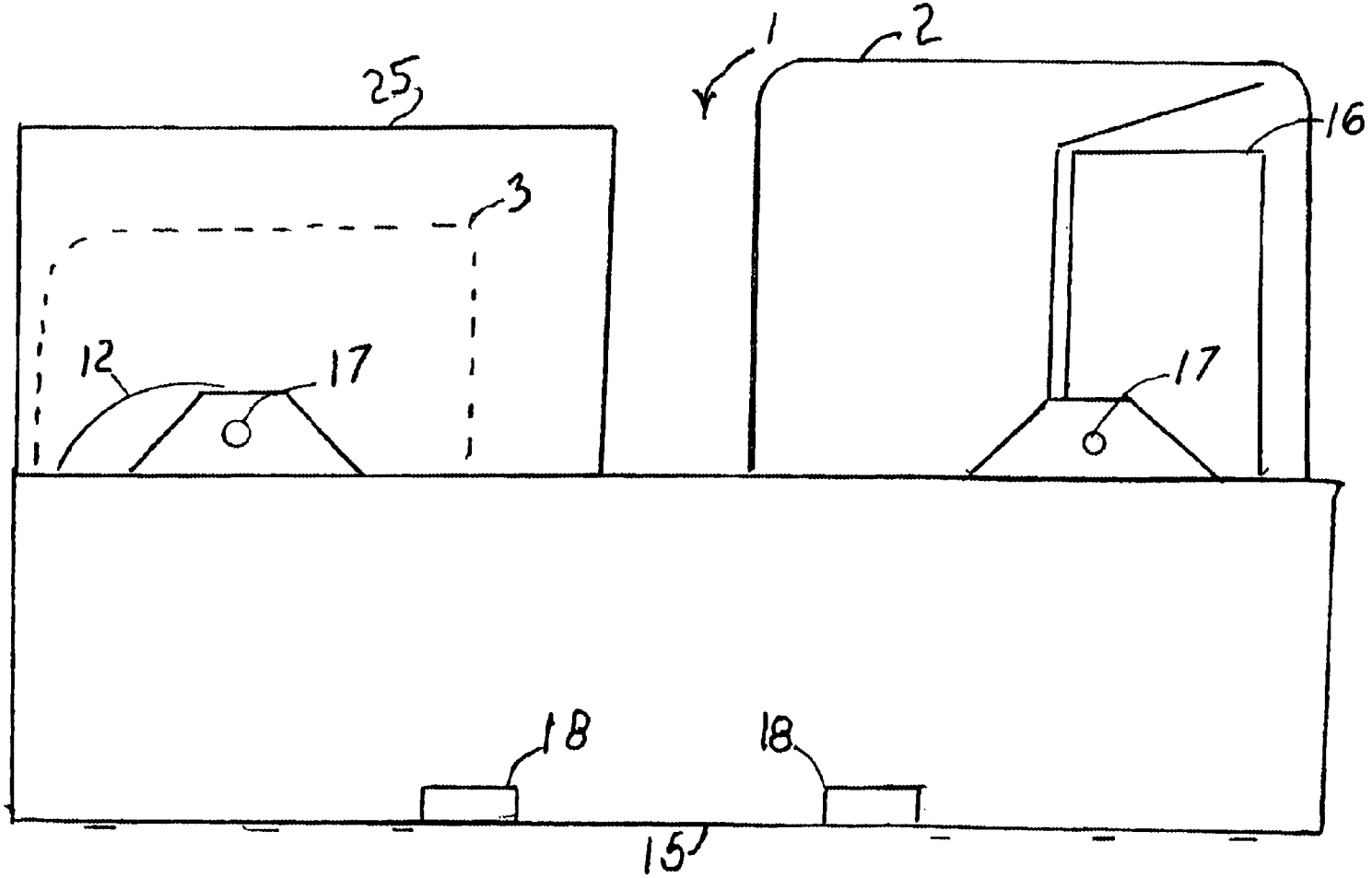
FIG. 2 is a side elevation view of the apparatus of FIG. 1.

Referring now to the drawing FIGS. 1 and 2, the apparatus 1 of the invention comprises a sturdy welded steel unitary base 15, designed to be lifted onto and off of conveyances and work areas. The base is provided with lifting eyes 17 to be lifted by a crane, for example. It is also provided with lifting apertures 18 for lifting with a forklift. Securely mounted upon the base is a 500 gallon water tank 2, and an internal combustion engine 3 complete and self contained with its own battery, alternator, and fuel supply. The engine is preferably a common gasoline engine such as a Ford 6 cylinder pickup truck engine, so that maintenance and parts are readily available. A governor on the engine maintains uniform engine speed as load changes. A 120 volt generator 19 is coupled to the engine to provide power to the water heater 16 that burns diesel fuel from fuel tank 20. The engine operates by power pulley connections 8,8' two three-stage high pressure pumps 4,5 that produce 3500 P.S.I. at outlets 7 from water fed from tank 2 to inlets 6. Power connection 8' may optionally include a clutch to disconnect the pump when not in use. The engine compartment is enclosed within a removable cover 25, shown partially broken away. Pump outlets 7 feed to hoses 9 on hose reels 12 through bypass mechanism 13. The bypass outputs may optionally feed to the hoses through water heaters 16. Each hose terminates in a cleaning wand 10 provided with a manual control 11. The operator squeezes the spring biased control to cause the high pressure water to escape onto the surface being cleaned. When the control is released, the bypass mechanism 13 senses that the pressure has built up in the hose and diverts the fluid back into the inlet. Such mechanisms 13 and pumps 4,5 are well known in the art. Also mounted on the base 15 are a tank 21 for a liquid soap or detergent, and a tank 22 for a chlorine solution. These tanks may contain other cleaning agents, as desired. These cleaning fluids may be dispensed into pouring cans stored in boxes 23 for pouring onto the surfaces being cleaned, as required. A locked box 24 is mounted on the base. It contains the operating controls and tools that may be secured.

The above disclosed invention has a number of particular features which should preferably be employed in combination, although each is useful separately without departure from the scope of the invention. While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A cleaning apparatus comprising:

a) a sturdy unitary base;

b) a water tank mounted on the base;

c) an internal combustion engine mounted on the base;

d) first and second high pressure water pumps mounted on the base, and having inlets connected to the tank and outlets;

e) power connections between the engine and the water pumps for actuating the pumps;

f) a flexible hose connecting each pump outlet to a cleaning wand with a control, each hose mounted on a reel on the base;

g) a bypass mechanism at each output for returning water to the tank when the control is closed;

h) a heater mounted on the base for each pump outlet;

i) lifting eyes on the base for lifting the base onto and off of conveyances and work areas;

j) and fork lift apertures in the base for lifting the apparatus onto and off of conveyances and work areas.

* * * * *